US006460964B2

(12) United States Patent
Osborne

(10) Patent No.: US 6,460,964 B2
(45) Date of Patent: Oct. 8, 2002

(54) THERMAL MONITORING SYSTEM FOR DETERMINING NOZZLE HEALTH

(75) Inventor: William S. Osborne, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/726,963

(22) Filed: Nov. 29, 2000

(65) Prior Publication Data

US 2002/0063745 A1 May 30, 2002

(51) Int. Cl.[7] ..... B41J 2/01
(52) U.S. Cl. ..... 347/19
(58) Field of Search ..... 347/19, 7, 40, 347/17, 23

(56) References Cited

U.S. PATENT DOCUMENTS

| | | | | |
|---|---|---|---|---|
| 5,072,235 A | | 12/1991 | Slowik et al. | 347/19 |
| 5,640,183 A | * | 6/1997 | Hackleman | 347/40 |
| 5,699,090 A | * | 12/1997 | Wade et al. | 347/7 |
| 5,721,573 A | | 2/1998 | Benjamin | 347/7 |
| 5,929,875 A | | 7/1999 | Su et al. | 347/19 |
| 6,036,298 A | | 3/2000 | Walker | 347/19 |
| 6,086,190 A | | 7/2000 | Schantz et al. | 347/81 |

FOREIGN PATENT DOCUMENTS

| | | |
|---|---|---|
| EP | 0444579 A2 | 9/1991 |
| EP | 0452116 A1 | 10/1991 |
| EP | 0955170 A1 | 11/1999 |
| EP | 0981105 A1 | 2/2000 |
| EP | 0983855 A2 | 3/2000 |
| JP | 59014967 | 1/1984 |

OTHER PUBLICATIONS

A copy of European Search Report Application No. EP01117038 mailed Mar. 8, 2002.

* cited by examiner

*Primary Examiner*—Craig Hallacher

(57) ABSTRACT

A thermal monitoring system determines whether a fluid ejecting nozzle is healthy and operating in a thermal fluid ejection system to eject precise amounts of fluid in response to a firing signal. If not, a nozzle recovery routine is preformed to remove any nozzle blockages, with different routines being preformed to address the type of blockage encountered. If recovery is not possible, or if the nozzle failure is detected "on-the-fly" during a normal fluid application routine, a substitute healthy nozzle is engaged without interrupting the job. Nozzle health is determined by monitoring the temperature change of the nozzle following application of the firing signal. In one embodiment, an inkjet printing mechanism uses a thermal inkjet printhead to eject an inkjet ink as the fluid. A method of monitoring the health of a fluid ejection nozzle is also provided.

53 Claims, 4 Drawing Sheets

FIRED RESISTOR'S THERMAL CHARACTERISTICS

THERMAL MONITORING SYSTEM FOR DETERMINING NOZZLE HEALTH

BACKGROUND

The concepts illustrated herein relate generally to thermal fluid ejection systems which eject precise amounts of fluid through one or more nozzles in response to a firing signal, including those used in inkjet printing mechanisms, and more particularly to a thermal monitoring system for determining whether a nozzle. is healthy.

One thermal fluid ejection system is used in inkjet printing mechanisms which have cartridges, often called "pens," that shoot drops of liquid colorant, referred to generally as "ink," onto a page. Each pen has a fluid-ejecting printhead formed with very small, pin-hole-sized nozzles through which the ink drops are ejected. To print an image, the printhead is propelled back and forth across the page, shooting drops of ink in a desired pattern as it moves. Two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization or firing chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

Non-functioning nozzles in the context of an inkjet printer may contribute to print quality defects when trying to print a desired image on a sheet of media, such as paper, and when dispensing other fluids, non-functioning nozzles result in an inadequate amount or inaccurate placement of the fluid on the receiving surface. There are a variety of possible causes for non-functioning nozzles, including: (1) internal jetting head contamination; (2) vapor bubbles within the jetting head; (3) crusting of the fluid over the nozzles; (4) external jetting head contamination; and (5) resistors which fail to fire. Other causes for non-functioning nozzles may exist, depending upon the particular implementation. Various schemes have been proposed to replace non-functioning nozzles with functioning nozzles in multipass fluid ejection routines or print modes, for instance, by using backup nozzles to help restore some of the fluid placement quality lost by the bad nozzles. These various fluid ejection routines or print mode schemes rely on the ability to reliably detect and determine when a nozzle is not functioning.

Unfortunately in the inkjet printing context, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Nozzle "spitting" routines eject ink to push dried ink clogs into a waste receptacle, referred to as a "spittoon" in the art. Besides merely forcing clogs out of the nozzles, spitting also heats the ink near the nozzles, which decreases the ink viscosity and assists in dissolving ink clogs.

Air bubbles lodged within the printhead may also prevent a nozzle from firing. These air bubbles may be pulled by a vacuum force from the printhead in a priming routine, such as that taught in U.S. Pat. Nos. 5,592,201 and 5,714,991, both assigned to the present assignee, the Hewlett-Packard Company. In devices which are not equipped with a priming system, the air bubbles may be pushed out of the printheads by applying a positive force to the ink reservoir supplying the printhead. For instance, an inkjet pen body may serve as an ink containment reservoir that protects the ink from evaporation and holds the ink so it does not leak or drool from the nozzles. Ink leakage is prevented using a force known as "backpressure," which is provided by the ink containment system. Desired backpressure levels may be obtained using various types of pen body designs, such as resilient bladder designs, spring-bag designs, and foam-based designs. By applying a force to the ink contained in these reservoirs, the ink itself may be used to push the air bubbles out of the nozzles.

In operating a precision fluid ejection system, such as an inkjet printing mechanism, it would be helpful to provide feedback to a print controller, such as a printer driver residing in an on-board microprocessor and/or in the host computer, as to whether or not the printhead nozzles are firing as instructed. This information would be useful to determine whether a nozzle had become clogged and required purging or spitting to clear the blockage. This information would streamline the spitting process and conserve ink because only the clogged nozzle(s) would be spit to clear the blockage. Moreover, if damaged nozzles or heating elements could be detected, then other nozzles may be substituted in the firing scheme to compensate for the damaged nozzles.

A variety of different schemes have been used to detect a failed nozzle. For example, a failed firing resistor may be detected by a special circuit in the printer that looks at the resistance of the drive circuit, and if the resistance indicates an open circuit then clearly the resistor will not fire because it cannot receive a firing pulse. Various sensors have been used in the past to detect whether a droplet has been ejected from a nozzle. For example, in one method a photo-diode and a light emitting diode (LED) pair are used to detect the shadow of a droplet passing between the photo-diode and the LED. One optical system measured the change in drop volume for a given firing temperature by firing smaller and smaller droplets until the drops could no longer be seen by an optical detector. Unfortunately, the target drop volume has decreased in newer inkjet cartridges, with some droplets now being on the order of 5 picoliters. These small droplets require either multiple firings to increase the signal or precise positioning of such an optical drop detector, which is difficult to implement consistently and reliably in production printing mechanisms.

In another system, a piezo electric film is used as a droplet target to detect whether or not a droplet impacts the target. In an electrostatic detection method, the positive or negative charge from an ejected droplet is detected. In yet another method, piezo-electric crystals are used to detect the acoustic signature generated as a droplet is ejected from the printhead. All of these methods have been built and tested, at least in a prototype environment, and have been found to effective at detecting nozzle outages, and in some cases, even weak or misdirected droplets.

Unfortunately, all of these earlier detection methods suffer two severe shortcomings. First, these earlier methods are unable to detect nozzles outages "on-the-fly" during normal fluid ejection activities, such as during printing. Second, these earlier methods are unable to detect nozzle outages at the full firing frequency of the jetting head. This inability to detect non-functioning nozzles on-the-fly during a print job or other fluid ejection activity may lead to serious problems, because nozzle health may change during any fluid ejection routine or print job. Since nozzles may fail on-the-fly, it would be desirable to have a nozzle replacement system which detects non-functioning nozzles on-the fly, and applies a correction system to utilize replacement nozzles on-the-fly so the resulting fluid ejection or print job occurs as originally intended with high quality.

SUMMARY OF THE INVENTION

According to one aspect of the present invention, a method is provided for monitoring the health of a fluid ejection nozzle which normally ejects a fluid in response to a firing signal. In this method several things occur, including: applying a firing signal to said nozzle; then thereafter, monitoring the temperature change of the nozzle; and finally determining from the monitored temperature change whether the nozzle ejected said fluid in response to the application of the firing signal.

According to another aspect of the invention, a fluid ejection mechanism is provided as including a fluid reservoir containing a fluid, and a fluid jetting head having a nozzle in fluid communication with the reservoir to receive the fluid and normally, in response to a firing signal, eject said fluid through this nozzle. Unfortunately, sometimes the nozzle is in "poor health" being clogged or blocked and unable to eject the fluid when asked. To address this issue, the fluid ejection mechanism also has a temperature sensor which monitors temperature change of said nozzle and generates a temperature signal in response to this change. The fluid ejection mechanism also has a controller which generates the firing signal. The controller also determines from the temperature signal whether the nozzle ejected the fluid in response to the application of the firing signal.

According to another aspect of the invention, a fluid ejection mechanism is provided with a fluid reservoir containing a fluid, and a fluid jetting head. The head has a nozzle which is in fluid communication with said reservoir to receive the fluid and normally, in response to a firing signal, eject the fluid through the nozzle. The fluid ejection mechanism also has means for applying the firing signal to said nozzle, and means for monitoring the temperature change of the nozzle. The fluid ejection mechanism also has a means for determining from the monitored temperature change whether the nozzle ejected the fluid in response to the application of the firing signal.

An overall goal herein is to provide a monitoring system for determining on-the-fly whether a thermal, fluid-ejecting nozzle is healthy during a firing routine without unnecessary interruption, and for employing nozzle recovery or replacement routines when unhealthy nozzles are found.

Another goal herein is to provide a thermal monitoring system for monitoring printhead nozzle health when installed in an inkjet printing mechanism.

DRAWINGS

DETAILED DESCRIPTION OF PREFERRED EMBODIMENTS

Figure 1:
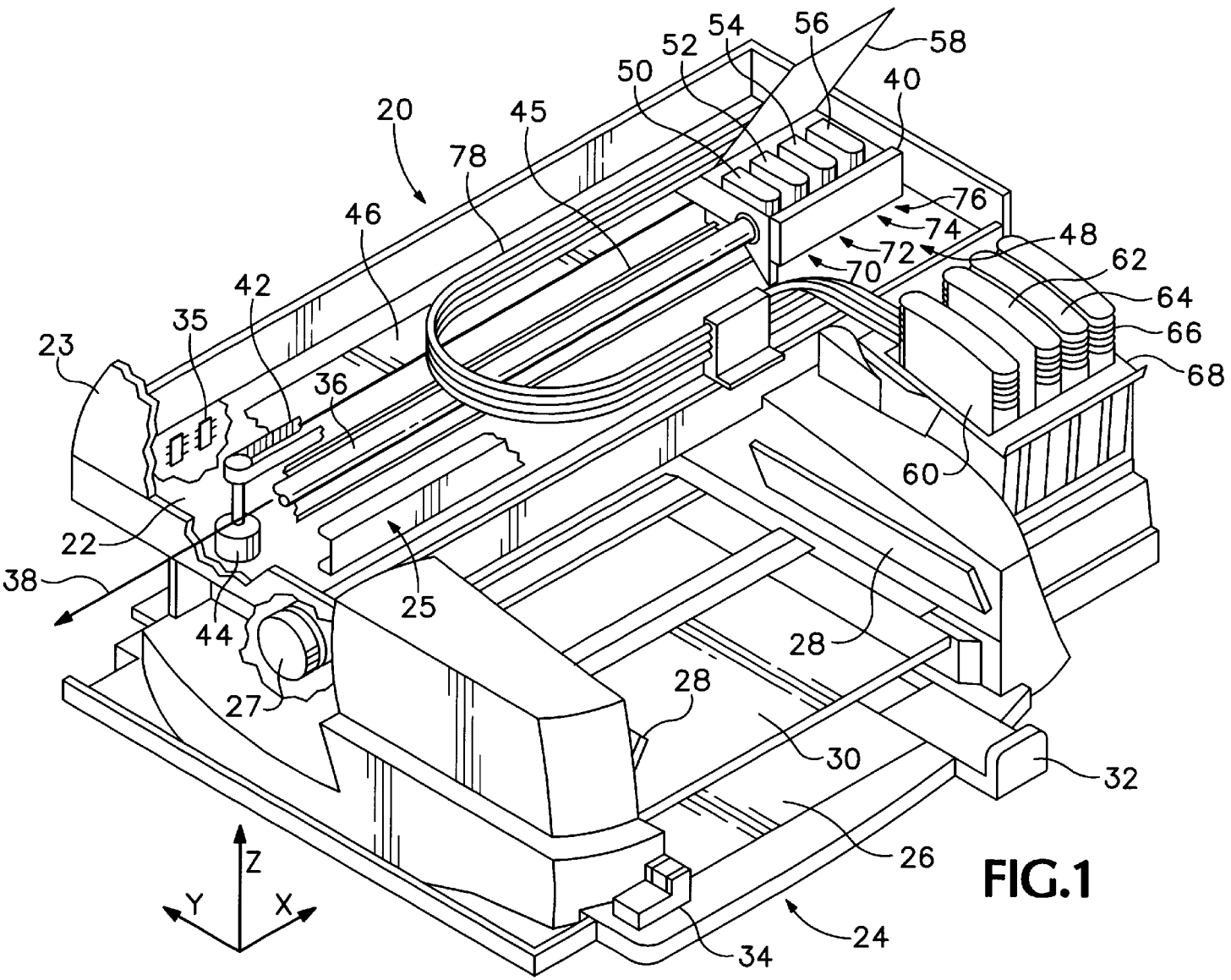
FIG. 1 is a perspective view of an example of one fluid ejection system, here shown as an inkjet printing mechanism using one form of an illustrated thermal monitoring system which determines the health of fluid ejecting nozzles supported therein.

FIG. 1 illustrates an embodiment of an fluid ejection system, here shown as an inkjet printing mechanism, and more specifically an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 23, the majority of which has been omitted for clarity in viewing the internal components. A print media handling system 24 feeds sheets of print media through a printzone 25. The print media may be any type of suitable sheet material, such as paper, card-stock, envelopes, fabric, transparencies, mylar, and the like, but for convenience, the illustrated embodiment is described using paper as the print medium. The print media handling system 24 has a media input, such as a supply or feed tray 26 into which a supply of media is loaded and stored before printing. A series of conventional media advance or drive rollers (not shown) powered by a motor and gear assembly 27 may be used to move the print media from the supply tray 26 into the printzone 25 for printing. After printing, the media sheet then lands on a pair of retractable output drying wing members 28, shown extended to receive the printed sheet. The wings 28 momentarily hold the newly printed sheet above any previously printed sheets still drying in an output tray portion 30 before retracting to the sides to drop the newly printed sheet into the output tray 30. The media handling system 24 may include a series of adjustment mechanisms for accommodating different sizes of print media, including letter, legal, A-4, envelopes, etc. To secure the generally rectangular media sheet in a lengthwise direction along the media length, the handling system 24 may include a sliding length adjustment lever 32, and a sliding width adjustment lever 34 to secure the media sheet in a width direction across the media width.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

The chassis 22 supports a guide rod 36 that defines a scan axis 38 and slideably supports an inkjet printhead carriage 40 for reciprocal movement along the scan axis 38, back and forth across the printzone 25. The carriage 40 is driven by a carriage propulsion system, here shown as including an endless belt 42 coupled to a carriage drive DC motor 44. The carriage propulsion system also has a position feedback system, such as a conventional optical encoder system, which communicates carriage position signals to the controller 35. An optical encoder reader may be mounted to carriage 40 to read an encoder strip 45 extending along the path of carriage travel. The carriage drive motor 44 then operates in response to control signals received from the printer controller 35. A conventional flexible, multi-conductor strip 46 may be used to deliver enabling or firing command control signals from the controller 35 to the printhead carriage 40 for printing, as described further below.

The carriage 40 is propelled along guide rod 36 into a servicing region 48, which may house a service station unit (not shown) that provides various conventional printhead servicing functions. To clean and protect the printhead, typically a service station mechanism is mounted within the printer chassis so the printhead(s) can be moved over the station for servicing and maintenance. For storage, or during non-printing periods, service stations usually include a capping system which hermetically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with this non-image producing waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead orifice plate.

A variety of different mechanisms may be used to selectively bring printhead servicing components like caps, wipers and primers (if used) into contact with the printheads, such as translating or rotary devices, which may be motor driven, or operated through engagement with the carriage 40. For instance, suitable translating or floating sled types of service station operating mechanisms are shown in U.S. Pat. Nos. 4,853,717 and 5,155,497, both assigned to the present assignee, Hewlett-Packard Company. A rotary type of servicing mechanism is commercially available in the DeskJet® 850C, 855C, 820C, 870C and 895C models of color inkjet printers (also see U.S. Pat. No. 5,614,930, assigned to the Hewlett-Packard Company), while other types of translational servicing mechanisms are commercially available in the DeskJet® 690C, 693C, 720C and 722C models, and 2000C Professional Series model of color inkjet printers, all sold by the Hewlett-Packard Company.

In the print zone 25, the media receives ink from an inkjet cartridge, such as a black ink cartridge 50 and three monochrome color ink cartridges 52, 54 and 56, secured in the carriage 40 by a latching mechanism 58, shown open in FIG. 1. The cartridges 50–56 are also commonly called "pens" by those in the art. The inks dispensed by the pens 50–56 may be pigment-based inks, dye-based inks, or combinations thereof, as well as paraffin-based inks, hybrid or composite inks having both dye and pigment characteristics. Of course in non-printing contexts, the fluid ejecting cartridges may be used to precisely eject other types of fluids.

The illustrated pens 50–56 each include reservoirs for storing a supply of ink therein. The reservoirs for each pen 50–56 may contain the entire ink supply on board the printer for each color, which is typical of a replaceable cartridge, or they may store only a small supply of ink in what is known as an "off-axis" ink delivery system. The replaceable cartridge systems carry the entire ink supply as the pen reciprocates over the printzone 25 along the scanning axis 38. Hence, the replaceable cartridge system may be considered as an "on-axis" system, whereas systems which store the main ink supply at a stationary location remote from the printzone scanning axis are called "off-axis" systems. In an off-axis system, the main ink supply for each color is stored at a stationary location in the printer, such as four refillable or replaceable main reservoirs 60, 62, 64 and 66, which are received in a stationary ink supply receptacle 68 supported by the chassis 22. The pens 50, 52, 54 and 56 have printheads 70, 72, 74 and 76, respectively, which eject ink delivered via a conduit or tubing system 78 from the stationary reservoirs 60–66 to the on-board reservoirs adjacent the printheads 70–76.

The printheads 70–76, representative of fluid ejecting or jetting heads, each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 38, with the length of each array determining the maximum image swath for a single pass of the printhead. The illustrated printheads 70–76 are thermal inkjet printheads, each including a plurality of resistors which are associated with the nozzles, as described in greater detail below with respect to FIG. 2. Upon energizing a selected resistor, a bubble of gas is formed which ejects a droplet of ink from the nozzle and onto a sheet of paper in the printzone 25 under the nozzle. The printhead resistors are selectively energized in response to firing command control signals received via the multi-conductor strip 46 from the controller 35.

Figure 2:
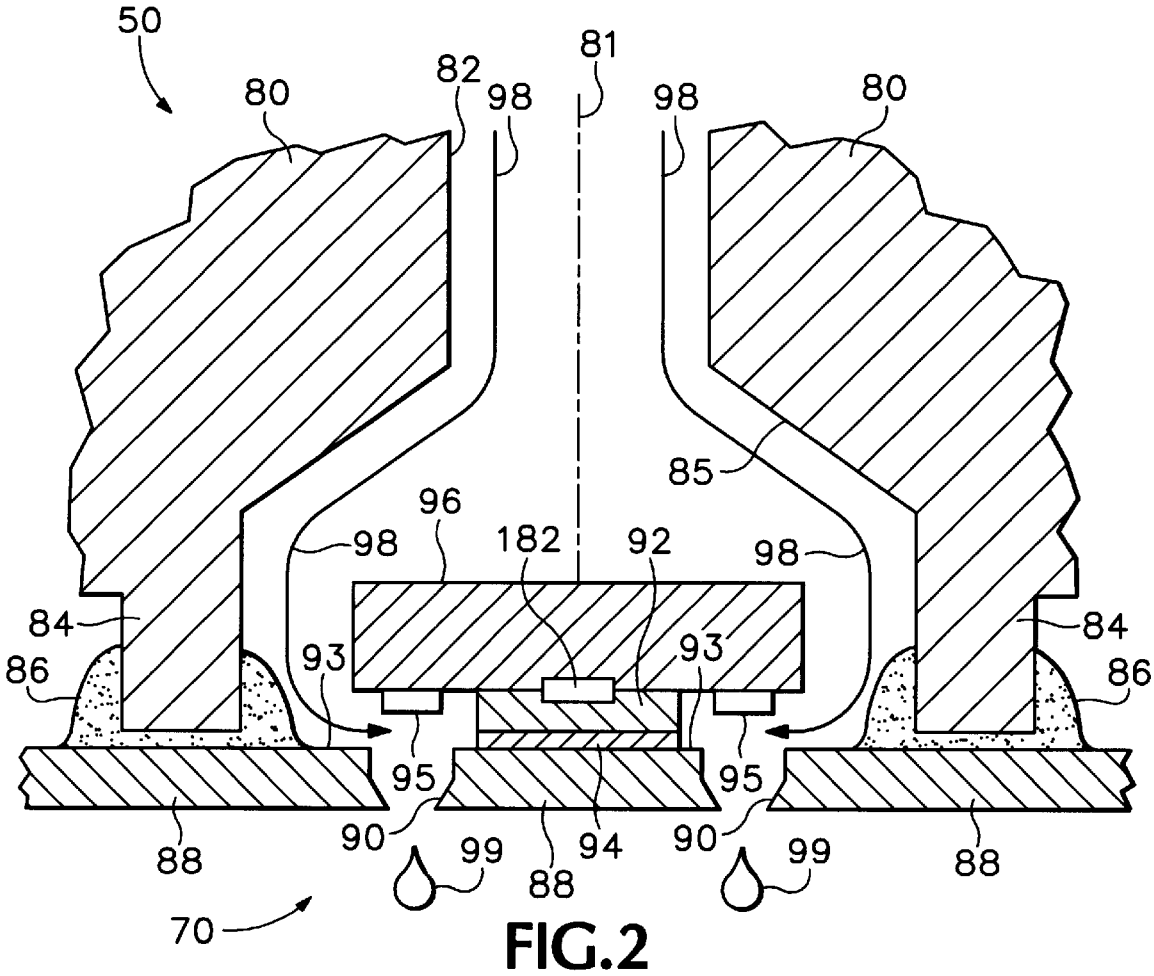
FIG. 2 is an enlarged, fragmented front sectional view of one form of a fluid ejecting head, here shown as an inkjet printhead with two nozzles ejecting ink droplets.

FIG. 2 shows one form of a fluid ejecting head, here shown as an inkjet printhead 70 of cartridge 50 which dispenses black ink. The illustrated cartridge 50 has a plastic body 80 bisected by a central axis 81. The body 80 defines an ink feed channel 82, which is in fluid communication with an ink reservoir located within the upper rectangular-shaped portion of the cartridge 50. The body 80 also has a raised wall 84 which defines a cavity 85 at the lower extreme of the feed channel 82. A conventional fluid ejection or jetting mechanism is centrally located within the fluid cavity 85, and held in place through attachment by an adhesive layer 86 to a flexible polymer tape 88, such as Kapton® tape, available from the 3M Corporation, Upilex® tape, or other equivalent materials known to those skilled in the art. The illustrated tape 88 also serves as a nozzle orifice plate by defining two parallel columns of offset nozzle holes or orifices 90 formed in tape 88 by, for example, laser ablation technology. The adhesive layer 86, which may be of an epoxy, a hot-melt, a silicone, an ultraviolet (UV) curable compound, or mixtures thereof, forms a fluid seal between the raised wall 84 and the tape 88.

The ink ejection mechanism includes a silicon substrate 96 that contains a plurality of individually energizable thin film firing resistors 95, each located generally behind a single, associated nozzle 90. The firing resistors 95 act as ohmic heaters when selectively energized by one or more enabling signals or firing pulses, which are delivered from the controller 36 through a flexible conductor to the carriage 40, and then through electrical interconnects to conductors (omitted for clarity) carried by the polymer tape 88. Communication between the printhead resistors 95 and controller 35 is preferably accomplished through the electrical interconnect between the pen 50 and the carriage 40. A barrier layer 92 may be formed on the surface of the substrate 96 using conventional photolithographic techniques. The barrier layer 92 may be a layer of photoresist or some other polymer, which, in cooperation with tape 88, defines vaporization chambers 93, each surrounding an associated firing resistor 95. The barrier layer 92 is bonded to the tape 88 by a thin adhesive layer 94, such as an uncured layer of polyisoprene photoresist. Ink from the cartridge supply reservoir flows through the fluid feed channel 82 as indicated by a pair of curved arrows 98, around the edges of the substrate 96, and into each of the vaporization chambers 93. When the firing resistors 95 are energized, ink within the vaporization chambers 93 is ejected, as illustrated by the emitted droplets of ink 99.

Figure 3:
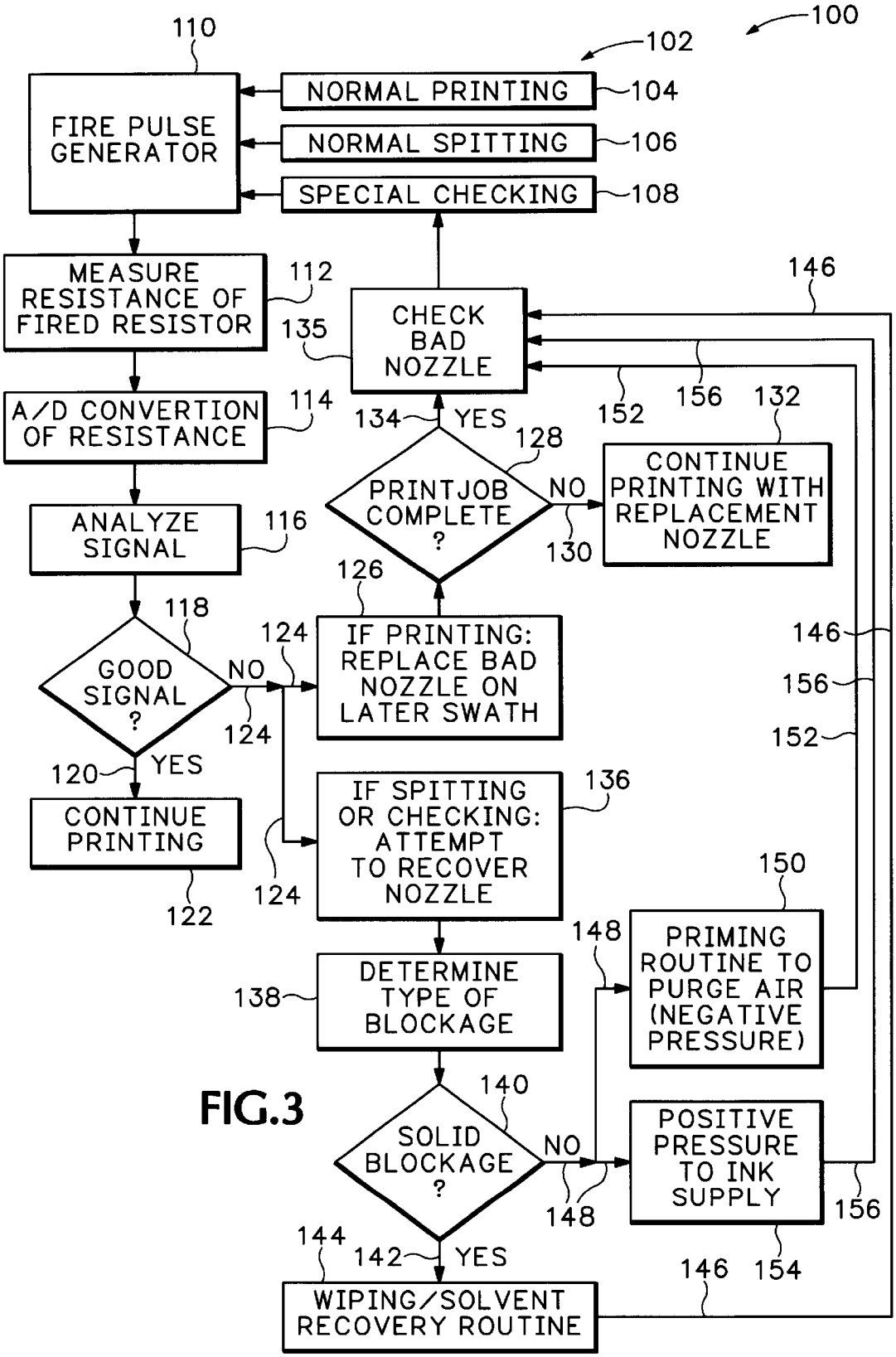
FIG. 3 is a flowchart of one form of a thermal monitoring system of FIG. 1.

FIG. 3 illustrates one form of a thermal monitoring system 100, constructed in accordance with the present invention. The thermal monitoring system 100 uses the thermal signature created during the ejection, or attempted ejection, of ink droplets 99 to determine whether or not a droplet was indeed ejected in response to a firing pulse received from the controller 35. The monitoring system 100 may be done "on-the-fly," that is, during a normal fluid ejection or printing routine, without requiring unnecessary time to be wasted while the printhead is positioned at a special sensor in the servicing region 48 as was the case with earlier systems discussed in the Background section above. Furthermore, monitoring nozzle health, and substituting functioning nozzles for non-functioning nozzles on-the-fly allows the printer 20 or other fluid ejection mechanism to make needed corrections so the ultimate job is not affected by any non-functioning nozzles.

The thermal monitoring system 100 may be started during any one of several initiating activities 102, such as during normal printing 104, during a normal nozzle purging or spitting routine 106, or during a special nozzle checking routine 108. When either of these initiating activities 104, 106 or 108 occurs, signals are sent by the printer controller 35 to a firing pulse generator 110, which applies a firing voltage across a selected resistor 95. In the time frame during which the selected resistor 95 is expected to fire, in a measuring step 112 the change in the resistance of the fired resistor is measured over time. Following this resistance measurement, in a converting step 114, an analog to digital (A/D) conversion is made of the resistance measured in step 112. This change in resistance of the fired resistor 95 over time may be plotted as curve 115, shown in the graph of FIG. 4. Following generation of the trace 115, a signal analysis step 116 is performed as described further below with respect to FIG. 4.

Figure 4:
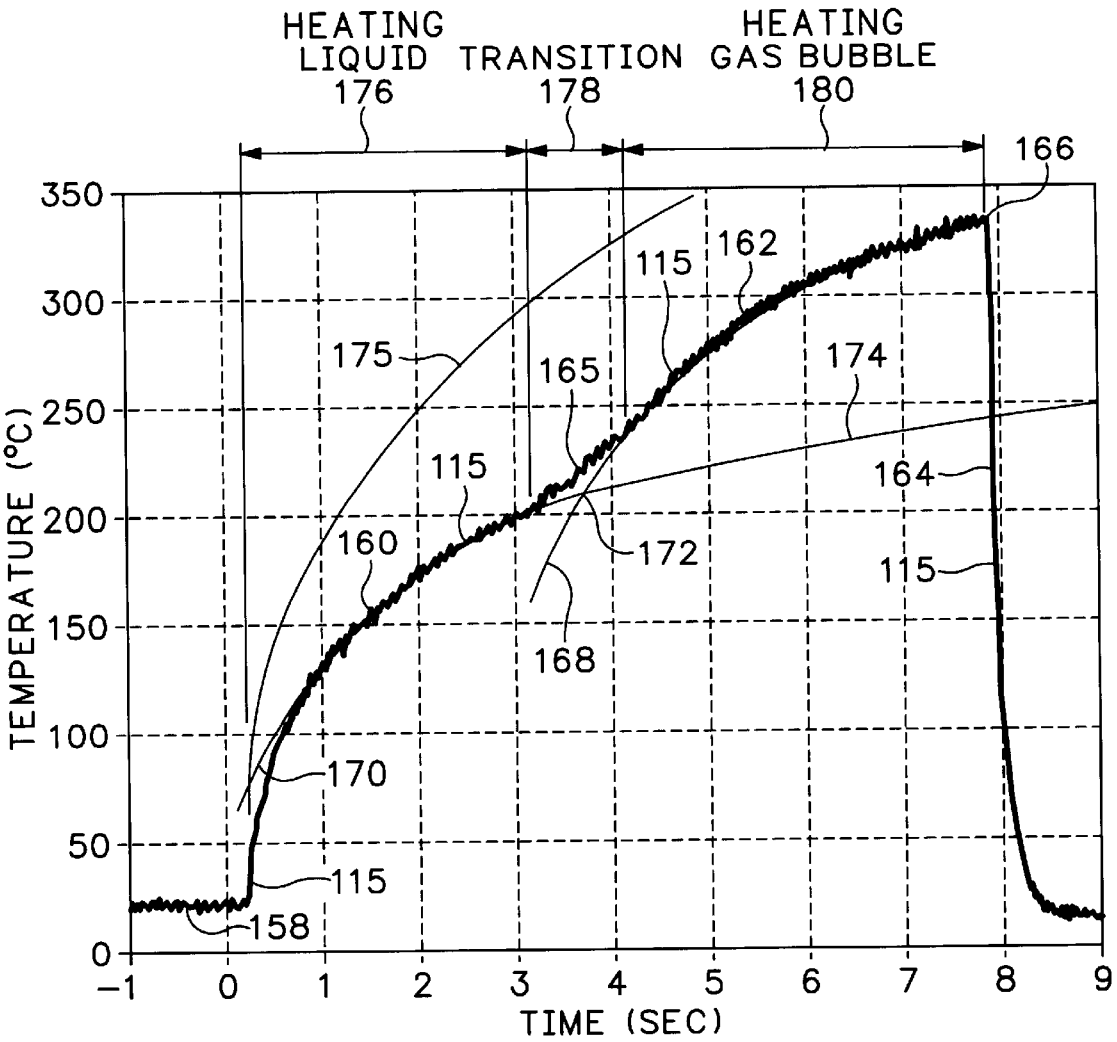
FIG. 4 is a graph of the thermal characteristics used by the thermal monitoring system of FIG. 1 to determine nozzle health.

In a determination step 118, the determination is made whether the resulting curve, such as 115 in FIG. 4, is a good signal, indicating a properly functioning nozzle 90. If a good signal is indeed found by step 118, a YES signal 120 is issued to a continuing step 122, where normal fluid ejection is then continued using the properly functioning nozzle 90. However, when a good signal is not found by the determination step 118, a NO signal 124 is issued. The next operation performed depends upon what particular initiating steps 104–108 were occurring when the selected nozzle 90 was being checked.

If the initiating step 104 during normal printing occurred, then the NO signal 124 goes to a replacing step 126, where the non-functioning bad nozzle is then replaced on the next printing swath by a properly functioning nozzle. At the completion of this latter print swath where the replacement nozzle was used in step 126, a querying step 128 then asks whether the print job is complete. If not, a NO signal 130 is issued to a continuing step 132, which then continues the print job using the replacement nozzle. When the querying step 128 determines that the print job is complete, a YES signal 134 is issued to a special checking step 135, where the suspected bad nozzle is checked by initiating the special checking routine 108.

Returning to the good signal determination step 118, if the NO signal 124 is issued following initiating the checking routine using steps 106 or 108 during a spitting or special checking routine, then a nozzle recovery step 136 receives the NO signal 124. The type of nozzle recovery routine attempted following step 136 depends upon the type of nozzle blockage and the type of recovery equipment available on the fluid ejecting unit, here, printer 20. First in a determining step 138, the exact type of nozzle blockage is determined by an analysis of the thermal characteristics of the fired resistor 95 when shown on a graph similar to FIG. 4, or through a tabulation of such data, as described further below. Next in a querying step 140, the question is asked whether the nozzle blockage is solid. If the nozzle blockage is indeed solid, a YES signal 142 is issued and a printhead wiping or solvent recovery routine 144 is performed. Following this recovery routine 144, a signal 146 is issued to the checking step 135, and the special nozzle checking initiating step 108 is performed.

If the querying step 140 determines that the blockage is not solid, a NO signal 148 is issued. Depending upon the type of fluid dispensing unit, such as the printer 20, blockages which are not solid, that is, which are vapor or air bubble blockages, may be cured in a variety of different ways. For instance, if the printer 20 includes a priming system, such as for instance that disclosed in U.S. Pat. No. 5,714,991, currently assigned to the Hewlett-Packard Company, then a priming step 150 is initiated. During this priming routine, air or vapor is purged from the printhead by applying negative pressure or a vacuum, to the orifice plate 88. Following this priming routine 150, a signal 152 is sent to the special checking step 135, and the special checking initiation step 108 is again activated to determine whether the priming operation of step 150 was effective in removing the nozzle blockage.

If the particular fluid ejection system does not have a priming system, then in a positive pressure application step 154 receives the NO signal 148 from the querying step 140. Step 154 then applies a positive pressure to the ink supply, such as by delivering pressure through the ink supply line 78 to the printhead 70 to push the air bubble blockage out of the nozzle 90. Following this positive pressure application step 154, a signal 156 is issued to the checking step 135, and the special check initiating step 108 is activated to determine whether the positive pressure application of step 154 was indeed successful in removing the air bubble blockage from the bad nozzle. Of course, if either the wiping/solvent recovery step 144, the priming step 150, or the positive pressure application step 154 was unsuccessful in clearing the blockage, then these steps may be repeated on successive iterations of the monitoring routine 100, or if printing is required, then the nozzle replacement routine 132 may be initiated.

As mentioned above, the analyzing step 116 and the determining the type of blockage step 138 use the thermal characteristics of the fired resistor shown in FIG. 4. The curve 115 illustrates the operation of a properly functioning nozzle 90 ejecting a fluid droplet 99. This curve 115 has several different segments and sections. The time zero (0) seconds indicates when the firing signal is first delivered by controller 35 to the resistor 95. Prior to time zero, the resistor 95 has an ambient temperature curve section 158 which is shown as approximately room temperature. Following application of the firing pulse, the resistor temperature begins to rise as shown by a first arced section 160, followed by a second arced section 162, until reaching a maximum temperature of approximately 330° C shortly before eight seconds have elapsed since the firing pulse was initiated at time zero. Following this maximum temperature, the curve 115 then rapidly drops in temperature, as shown for curve section 164 until again returning to ambient temperature before the nine-second point in time.

During the first arced portion 160 of curve 115, energy from the resistor 95 is being transferred to the liquid surrounding the resistor, here ink. The second arced portion 162 of curve 115 shows the heat transfer where the resistor 95 is now heating the gas bubble being formed as the liquid boils. A properly functioning nozzle will generate a thermal characteristic having a transition 165, where the two-arced curve sections 160 and 162 join. During this transition phase 165, the air bubble is formed as the liquid, here ink, begins to boil. When the gas bubble eventually bursts, the ink droplet 99 is then ejected from the nozzle 90, shown at a knee portion 166 of curve 115 where curve portions 162 and 164 join together.

Thus, the good signal determining step 118 looks for the transition 165 of curve 115, which may occur over a region of approximately a second, somewhere between three and five seconds as shown in FIG. 4 for the illustrated printhead 70. In determining whether the transition point 165 exists, the first and second arced curve sections 160 and 162 may be mathematically approximated as straight-line traces. For instance, when the resistor 95 is heating the gas bubble, the curve 162 may be approximated by a straight-line curve 168. Similarly, when the resistor 95 is heating the liquid, the first arced curve 160 may be approximated by a straight-line curve 170. When an intersection 172 between these two mathematical curve approximations 168 and 170 is encountered, step 118 then determines that indeed a gas bubble has formed and the nozzle 90 is functioning properly. The mathematical approximations of generating curves 168 and 170 to determine whether the inflection point 172 occurred is preferred over a graphical analysis of the raw data because it is easier to detect point 172 than the actual signal inflection portion 165 of curve 115.

Thus, operation of the good signal determination step 118 is now understood. As mentioned above, the thermal characteristics of FIG. 4 may also be used by the determining step 138 to determine which type of blockage, solid or air has been encountered. Knowing the type of nozzle blockage then is used to determine which type of nozzle recovery routine is performed, either the wiping/solvent application routine 144, the priming routine 150, or positive pressure application routine 154. For instance, a solid blockage may be found when there is no transition 165 within the trace 115. During a solid nozzle blockage episode, the resistor 95 heats up along the first arced portion 160, and then instead of transitioning at point 165, the temperature continues on as shown for curve 174, where the heat continues to be dissipated into the liquid without a bubble eruption occurring, such as at point 166 of curve 115. Thus, when the nozzle thermal characteristic follows the path of curve 174, a solid blockage is considered to have been found and YES signal 142 is generated to initiate the wiping and/or solvent recovery routine 144.

During a vapor or air bubble nozzle blockage episode, following the initial application of the firing pulse the resistor thermal characteristics follow along the trace of curve 175, and then monitoring system 100 determines that the nozzle is blocked by a bubble. Note in the graph of FIG. 4 how the vapor/air bubble blockage curve 175 follows approximately the same arc as the second portion 162 of the thermal trace 115, where the heat energy of resistor 95 is being expended into the gas or air bubble. Thus, when a gas bubble blockage is detected, the NO signal 148 is generated to initiate either the priming routine 150 or the positive pressure application routine 154 to either pull or blow the air bubble from the nozzle 90.

In summary, the temperature history of an inkjet resistor 95 during drop ejection may be broken down into three phases, shown in FIG. 4 as a pre-nucleation stage 176, a nucleation stage 178, and a post-nucleation stage 180. During the pre-nucleation phase 176 the ink is in contact with the resistor 95 when the drive current is applied by the firing pulse generator 110. At the nucleation stage 178, some of the liquid at the interface between the firing resistor and the liquid changes phase from liquid to gas. After nucleation in the post-nucleation stage 180, the hot resistor 95 is in contact only with ink vapor, referred to herein as a gas or bubble. As shown in FIG. 4, the thermal signatures 160 and 162 of the respective pre-nucleation and post nucleation stages 176 and 180 are different due to the different heat capacities and thermal conductivities of the fluid in the liquid phase versus those for the fluid in a gas phase. By knowing these characteristics of a healthy nozzle trace 115, this thermal profile may be used to determine whether a nozzle is healthy or not.

Instead of merely applying a curve fitting routine to generate curves 168 and 170 to look for the inflection point 172, a mathematical routine may be performed on the incoming data. In this mathematical routine, the second derivative of the thermal characteristic is computed to find the rate of rise of the temperature. If this second derivative curve never passes through the value zero (0), which would represent the inflection point 165, then it is determined that the firing chamber of nozzle 90 did not successfully cause nucleation so no gas bubble was formed, corresponding to the trace of curve 174. Thus, step 140 determines that the blockage is indeed solid and the YES signal 142 is generated.

An alternate method to detect nozzle health thermally involves looking at the rise in temperature of the resistor 95 after the firing pulse is provided by the generating step 110. As mentioned above, gas blockages appear as thermal characteristics shown for curve 175, indicating that resistor 95 is in contact with air and that the nozzle 90 is de-primed. Furthermore, if an air blockage has occurred the resulting temperature decay rate will be greatly reduced, as can be seen by the rapid rise of curve 175 well above the healthy nozzle trace 115.

In one embodiment, measurement of the resistor temperature may be done by using the change in resistance or conductivity of the resistor 95 itself. Alternatively, a heat sensing resistor or other thermal sensor, such as thermal sensor 182 may be embedded in the printhead near the firing resistors 95. It is apparent that a separate thermal sensor 182 may be placed in a variety of different locations, with only one preferred location being shown in FIG. 2 for the particular printhead design illustrated. However, for the case of simplicity, it may be easier just to use the firing resistor 95 to determine whether an associated nozzle 90 is functioning properly.

Furthermore, while the thermal characteristics of FIG. 4 are shown for one particular type of printhead nozzle, it is apparent that depending on the type of nozzle and fluid ejection head design, as well as the type of fluid used, that the exact shape and placement of the healthy nozzle trace, as well as the blocked nozzle traces 174, 175 may vary from those illustrated in FIG. 4. Additionally, while the thermal monitoring system 100 is described herein in terms of the ejected fluid being an ink, and the printhead carrying vehicle being an inkjet printer 20, it is apparent that this nozzle health monitoring system 100 may be used in other fluid ejection applications, such as fluid ejection processes used in manufacturing, electronics, medical, appliance, food, automotive, and other industries where precise fluid dispensing is desired. Additionally, by monitoring nozzle health during normal fluid ejection activities, unhealthy nozzles may be readily detected and treated with various recovery routines, such as 144, 150 and 154, to readily bring the bad nozzle back to health before permanent damage may be sustained.

I claim:

1. A method of monitoring the health of a fluid ejection nozzle which normally ejects a fluid in response to a firing signal, comprising:

applying a firing signal to said nozzle;

thereafter, monitoring the temperature change of the nozzle;

determining from the monitored temperature change whether the nozzle ejected said fluid in response to the application of the firing signal; and when said nozzle fails to eject said fluid, ejecting fluid from a substitute nozzle.

2. A method according to claim 1 wherein the firing signal is applied during a normal fluid ejection job.

3. A method according to claim 2 wherein following completion of said normal fluid ejection job, the method further includes recovering the functionality of said nozzle which failed to eject said fluid.

4. A method according to claim 3 wherein the method further includes determining whether said recovering of the nozzle which failed was successful.

5. A method according to claim 4 wherein when said recovering of the nozzle which failed was unsuccessful, the method further includes continuing to use said substitute nozzle as a substitute for the nozzle which failed.

6. A method according to claim 5 wherein said fluid comprises an inkjet ink, and said normal fluid ejection job comprises a print job.

7. A method according to claim 1 wherein when the firing signal is applied during a normal nozzle spitting routine and said nozzle failed to eject said fluid, the method further includes recovering the functionality of said failed nozzle.

8. A method according to claim 7 wherein the method further includes deciding what type of blockage caused the failure of said nozzle, and said recovering comprises using a recovery routine corresponding to the decided type of blockage which caused the failure of said nozzle.

9. A method according to claim 8 wherein:

when the decided type of blockage comprises a solid blockage, said recovery routine comprises wiping said nozzle; and when the decided type of blockage comprises a vapor blockage, said recovery routine comprises applying pressure to remove said vapor blockage from said nozzle.

10. A method according to claim 8 wherein the method further includes determining whether said recovering of said failed nozzle was successful.

11. A method according to claim 10 wherein when said recovering of said failed nozzle was unsuccessful, the method further includes continuing to use said substitute nozzle as a substitute for sailed failed nozzle.

12. A method according to claim 8 wherein said fluid comprises an inkjet ink.

13. A method according to claim 1 wherein:

said applying comprises applying said firing signal to a firing resistor associated with said nozzle; and said monitoring comprises monitoring the change in resistivity of said firing resistor.

14. A method according to claim 1 wherein:

said applying comprises applying said firing signal to a firing resistor associated with said nozzle; and said monitoring comprises monitoring the change in conductivity of said firing resistor.

15. A method according to claim 1 wherein:

the method further comprises providing a thermal sensor thermally adjacent to said nozzle to generate a temperature signal in response to temperature changes of said nozzle; and said monitoring comprises monitoring the temperature signal.

16. A method according to claim 15 wherein said thermal sensor comprises a heat sensing resistor.

17. A method according to claim 1 wherein said determining comprises:

graphing a trace of the monitored temperature change over time; and when an inflection region is found in said trace, determining said nozzle successfully ejected said fluid.

18. A method according to claim 1 wherein said determining comprises:

applying a curve fitting routine to the monitored temperature change over time and generating a trace therefrom; and when an inflection point is found in said trace, determining said nozzle successfully ejected said fluid.

19. A method according to claim 1 wherein said determining comprises:

generating a second derivative curve of the monitored temperature change over time; and when the second derivative curve passes through zero, determining said nozzle successfully ejected said fluid.

20. A method according to claim 1 wherein said determining comprises analyzing the rate of rise of the monitored temperature change following application of the firing signal.

21. A method according to claim 20 wherein when the analyzed rate of rise is greater than the rate of rise for a normally function nozzle, determining said nozzle is blocked by a vapor bubble.

22. A method according to claim 21 wherein when said nozzle is blocked by said vapor bubble, the method further includes recovering said nozzle by applying pressure to remove said vapor bubble from said nozzle.

23. A method of monitoring the health of a fluid ejection nozzle which normally ejects a fluid in response to a firing signal, comprising:

applying a firing signal to said nozzle;

thereafter, monitoring the temperature change of the nozzle;

determining from the monitored temperature change whether the nozzle ejected said fluid in response to the application of the firing signal;

when said nozzle fails to eject said fluid, deciding which type of blockage caused the failure of said nozzle; and recovering functionality of said nozzle, including using a recovery routine corresponding to the decided type of blockage.

24. A method according to claim 23 wherein when the decided type of blockage comprises a solid blockage, said recovery routine comprises wiping said nozzle.

25. A method according to claim 24 wherein said recovery routine further comprises applying a solvent to said nozzle.

26. A method according to claim 23 wherein when the decided type of blockage comprises a vapor blockage, said recovery routine comprises applying a positive pressure to push said vapor blockage out of said nozzle.

27. A method according to claim 23 wherein when the decided type of blockage comprises a vapor blockage, said recovery routine comprises applying a vacuum pressure to pull said vapor blockage out of said nozzle.

28. A method according to claim 23 wherein said fluid comprises an inkjet ink.

29. A method according to claim 23 wherein the method further includes determining whether said recovering of said failed nozzle was successful.

30. A method according to claim 29 wherein when said recovering of said failed nozzle was unsuccessful, the method further includes using another nozzle as a substitute for said failed nozzle.

31. A fluid ejection mechanism, comprising:

a fluid reservoir containing a fluid;

a fluid jetting head having a nozzle in fluid communication with said reservoir to receive said fluid and normally, in response to a firing signal, eject said fluid therethrough;

a temperature sensor which monitors temperature change of said nozzle and generates a temperature signal in response thereto; and a controller which generates said firing signal, and which determines from the temperature signal whether the nozzle ejected said fluid in response to the application of the firing signal, wherein the jetting head has another nozzle in fluid communication with said reservoir, and when the controller determines said nozzle has failed to eject said fluid, the controller diverts said firing signal to said another nozzle to eject said fluid therethrough as a substitute nozzle for said failed nozzle.

32. A fluid ejection mechanism according to claim 30 wherein when the controller determines said nozzle has failed during a normal fluid ejection job, the controller diverts said firing signal to said another nozzle without interrupting said normal fluid ejection job.

33. A fluid ejection mechanism according to claim 31 wherein:

the fluid ejection mechanism comprises an inkjet printing mechanism;

the fluid comprises an inkjet ink; and the fluid jetting head comprises an inkjet printhead.

34. A fluid ejection mechanism according to claim 31 wherein the fluid jetting head has a firing resistor associated with said nozzle, with the firing resistor operating in response to said firing signal.

35. A fluid ejection mechanism according to claim 31 wherein the temperature sensor comprises a firing resistor associated with said nozzle, with the firing resistor having a resistivity which changes in response to temperature changes of said nozzle, with the temperature signal comprising a signal representative of the firing resistor resistivity.

36. A fluid ejection mechanism according to claim 31 wherein the temperature sensor comprises a firing resistor associated with said nozzle, with the firing resistor having a conductivity which changes in response to temperature changes of said nozzle, with the temperature signal comprising a signal representative of the firing resistor conductivity.

37. A fluid ejection mechanism according to claim 31 wherein the temperature sensor comprises a heat sensing resistor thermally adjacent to said nozzle to generate said temperature signal.

38. A fluid ejection mechanism according to claim 31 wherein the controller analyzes the temperature signal by generating a graph of the monitored temperature change over time, and when an inflection region is found in the graph the controller determines said nozzle successfully ejected said fluid.

39. A fluid ejection mechanism according to claim 31 wherein the controller analyzes the temperature signal by applying a curve fitting routine to the monitored temperature change over time and generating a graph therefrom, and when an inflection point is found in the graph the controller determines said nozzle successfully ejected said fluid.

40. A fluid ejection mechanism according to claim 31 wherein the controller analyzes the temperature signal by generating a second derivative curve of the monitored temperature change over time, and when the second derivative curve passes through zero the controller determines said nozzle successfully ejected said fluid.

41. A fluid ejection mechanism according to claim 31 wherein the controller analyzes the temperature signal by analyzing the rate of rise of the monitored temperature change following generation of the firing signal.

42. A fluid ejection mechanism, comprising:

a fluid reservoir containing a fluid;

a fluid jetting head having a nozzle in fluid communication with said reservoir to receive said fluid and normally, in response to a firing signal, eject said fluid therethrough;

a temperature sensor which monitors temperature change of said nozzle and generates a temperature signal in response thereto; and a controller which generates said firing signal, and which determines from the temperature signal whether the nozzle ejected said fluid in response to the application of the firing signal, wherein when the controller determines said nozzle has failed to eject said fluid due to a nozzle blockage, the controller determines the type of nozzle blockage and generates a recovery signal to remove the determined type of nozzle blockage.

43. A fluid ejection mechanism according to claim 42 wherein the controller analyzes the temperature signal to determine the type of nozzle blockage.

44. A fluid ejection mechanism according to claim 43 wherein:

the mechanism further includes a priming mechanism which applies a vacuum to the nozzle in response to a priming signal; and when the controller determines the type of nozzle blockage comprises a vapor blockage, the recovery signal generated comprises the priming signal.

45. A fluid ejection mechanism according to claim 43 wherein:

the mechanism further includes a positive pressure mechanism which applies a positive pressure to the fluid within said reservoir in response to a pressure signal; and when the controller determines the type of nozzle blockage comprises a vapor blockage, the recovery signal generated comprises the pressure signal.

46. A fluid ejection mechanism according to claim 43 wherein:

the mechanism further includes a wiping mechanism which wipes the nozzle in response to a wiping signal; and when the controller determines the type of nozzle blockage comprises a solid blockage, the recovery signal generated comprises the wiping signal.

47. A fluid ejection mechanism according to claim 46 wherein:

the mechanism further includes a solvent application mechanism which applies a solvent for said fluid to the nozzle in response to a solvent application signal; and when the controller determines the type of nozzle blockage comprises a solid blockage, the recovery signal generated comprises the solvent application signal.

48. A fluid ejection mechanism, comprising:

a fluid reservoir containing a fluid;

a fluid jetting head having a nozzle in fluid communication with said reservoir to receive said fluid and normally, in response to a firing signal, eject said fluid therethrough;

means for applying the firing signal to said nozzle;

means for monitoring the temperature change of the nozzle;

means for determining from the monitored temperature change whether the nozzle ejected said fluid in response to the application of the firing signal; and means for ejecting fluid from a substitute nozzle when said nozzle fails to eject said fluid.

49. A fluid ejection mechanism according to claim 48 further including:

responsive to a first recovery signal, first means for recovering said nozzle when failing to eject said fluid due to a first type of block a responsive to a second recovery signal, second means for recovering said nozzle. when failing to eject said fluid due to a second type of blockage;

means for determining whether the first type of blockage or the second type of blockage has occurred; and means for generating the first recovery signal when the first type of blockage is determined to have occurred, and for generating the second recovery signal when the second type of blockage is determined to have occurred.

50. A fluid ejection mechanism according to claim 48 wherein:

the fluid ejection mechanism comprises an inkjet printing mechanism;

the fluid comprises an inkjet ink; and the fluid jetting head comprises an inkjet printhead.

51. A fluid ejection mechanism, comprising:

a fluid reservoir containing a fluid;

a fluid jetting head having a nozzle in fluid communication with said reservoir to receive said fluid and normally, in response to a firing signal, eject said fluid therethrough;

means for applying the firing signal to said nozzle;

means for monitoring the temperature change of the nozzle;

means for determining from the monitored temperature change whether the nozzle. ejected said fluid in response to the application of the firing signal; and means for determining when said nozzle has failed to eject said fluid due to a nozzle blockage and generating a recovery signal to remove the determined type of nozzle blockage.

52. A fluid ejection mechanism according to claim 51 further including:

means for ejecting fluid from a substitute nozzle when said nozzle fails to eject said fluid.

53. A fluid ejection mechanism according to claim 51 wherein:

the fluid ejection mechanism comprises an inkjet printing mechanism;

the fluid comprises an inkjet ink; and the fluid jetting head comprises an inkjet printhead.

* * * * *

UNITED STATES PATENT AND TRADEMARK OFFICE

CERTIFICATE OF CORRECTION

PATENT NO. : 6,460,964 B2
DATED : October 8, 2002
INVENTOR(S) : Osborne

It is certified that error appears in the above-identified patent and that said Letters Patent is hereby corrected as shown below:

Column 15,
Line 46, delete “block a” and insert therefor -- blockage; --.

Column 16,
Line 29, delete “nozzle.” and insert therefor -- nozzle --.

Signed and Sealed this

Twelfth Day of October, 2004

JON W. DUDAS
*Director of the United States Patent and Trademark Office*